US005643115A

United States Patent [19]

Dudley

[11] Patent Number: 5,643,115

[45] Date of Patent: Jul. 1, 1997

[54] ARROW DECELERATOR

[76] Inventor: Jerome Michael Dudley, 210, N. Pleasant Ave., Galesburg, Ill. 61401

[21] Appl. No.: 629,004

[22] Filed: Apr. 8, 1996

[51] Int. Cl.[6] ..... F42B 6/06

[52] U.S. Cl. ..... 473/578; 473/586

[58] Field of Search ..... 273/416, 420, 273/423; 473/578, 586

[56] References Cited

U.S. PATENT DOCUMENTS

| | | | |
|---|---|---|---|
| 1,009,640 | 11/1911 | Borges | 273/423 |
| 1,675,482 | 7/1928 | Boyet | 273/416 X |
| 2,848,834 | 8/1958 | Cox | 273/416 X |
| 3,337,219 | 8/1967 | Saunders | 273/423 |
| 3,428,321 | 2/1969 | Manning | 273/423 |
| 3,738,657 | 6/1973 | Cox | 273/420 |
| 3,945,642 | 3/1976 | Henthorn, Jr. | 273/420 |

*Primary Examiner*—William H. Grieb

[57] ABSTRACT

An attachable braking device for an arrow that allows passage of air through a construction in line with arrow's flight during initial thrust from a bow and then proceeds to impede that forward flight progress after the momentum has slowed by effecting a stoppage of air stream brought about by the movement of flexable plastic foam wing panels attached to double walled vanes angularly extended from an elongated inverse quarter channel and controlled by elastic members reaching from a notched bridge support member between those vanes through the flexable plastic foam panels to slitted keepers located on the back sides of the panels.

1 Claim, 1 Drawing Sheet

ARROW DECELERATOR

DESCRIPTION

1. Technical Field

The invention relates to archery equipment and more particularly to a special purpose combination flexable wings design controlled in part by the forward movement of an arrow and a elastic member attached to said wings.

2. Background Art

Arrow decelerators in the prior art consisted of large feathers arranged in various configurations on the arrow shaft and commonly referred to as a "Flu Flu" design. It is the object of the invention to devise a non-mechanical braking device that will slow the forward movement of an arrow shaft after it's initial forward momentum has ceased.

DISCLOSURE OF THE INVENTION

The object of the invention has been met by a pair of flexable foam plastic wing panels attached to the trailing edges of fixed double walled vanes angularly extending from the sides of an elongated inverted quarter channel and controlled in part by an elastic member attached to said wings from a notched bridge member located between said vanes said elastic member capable of drawing together the trail-edges of said wings to form a closure over said quarter channel thus causing a braking action to impede the forward movement of said arrow.

BEST MODE FOR CARRYING OUT THE INVENTION

Figure 1:
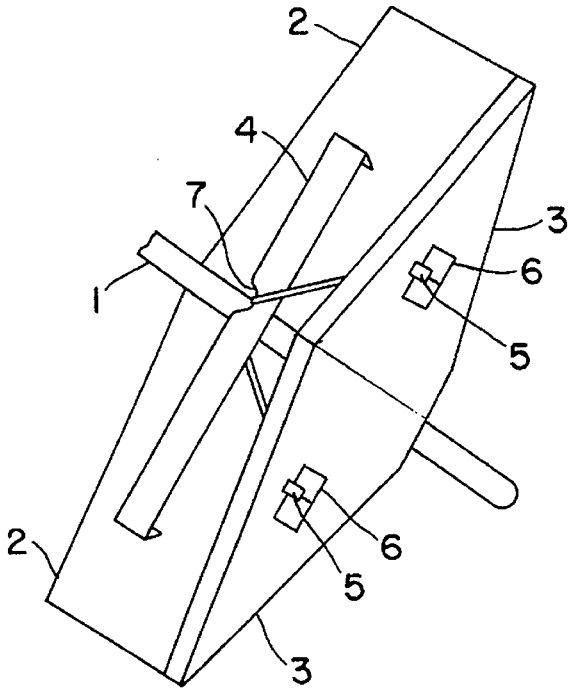
FIG. 1 is a top rear view of the present invention in it's pre and after flight configuration.

With reference to FIG. 1 one embodiment of the arrow decelerator is the resilient frame structure comprizing in combination a inverse elongated quarter channel 1 from which angularly spaced double walled vanes 2 extend said vanes 2 joined above said channel 1 by a bridge member 4 said bridge member 4 having a notch 7 from which extend a elastic member 5 reaching through wing panels 3 for attachment to keepers 6 on the backs of said wing panels 3 thus forming a closure over elongated quarter channel 1.

Figure 2:
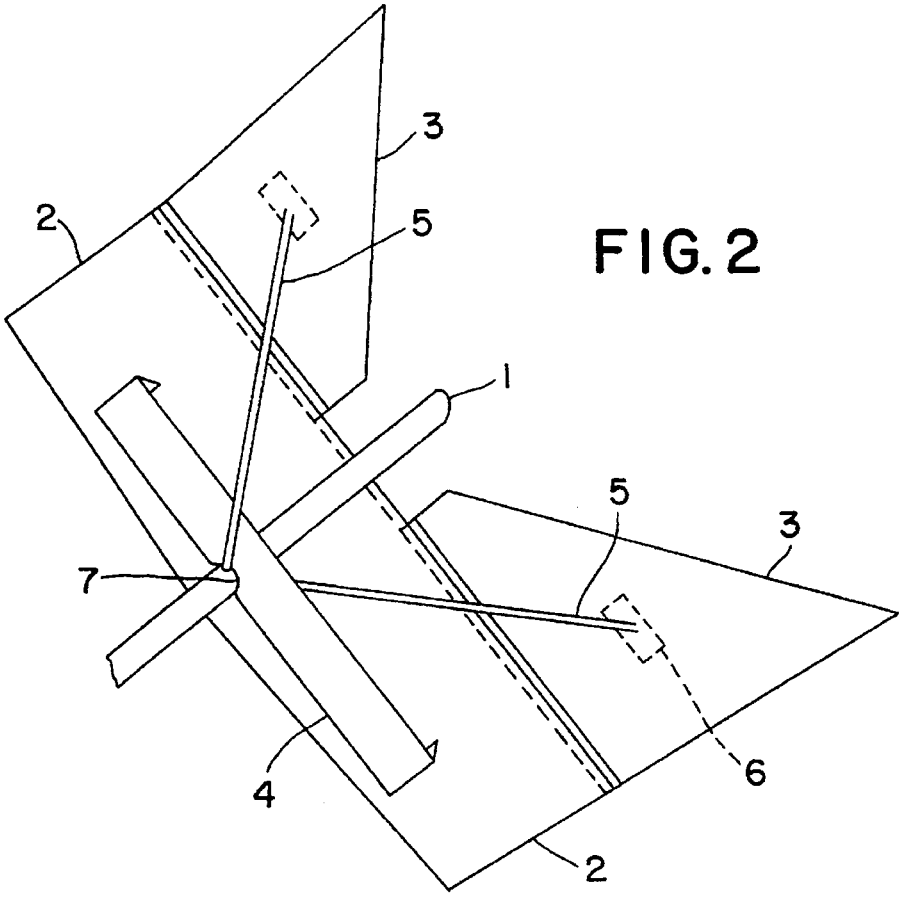
FIG. 2 is a top view of the present invention during flight with wings extended and elastic members stretched.

With reference to FIG. 2 showing the in flight configuration of the arrow decelerator where the wings 3 are fully extended in line with vanes 2 and elastic member 5 is stretched to allow wing panels 3 to attain that position.

While various changes may be made in the detailed construction it shall be understood that such changes shall be within the spirit and scope of the present invention as defined by the appended claims.

What I claim as new and desire to protect by Letters Patent of the United States is:

1. A arrow attachable plastic decelerater device comprizing in combination; a elongated inverted quarter channel member having a length with a fore and aft end and midway of same having angularly extending double walled vanes connected by a notched bridge member from which a elastic member's two ends extend rearwardly through the midsections of a pair of triangular shaped foam plastic flexable wing panels, each panel's hingable edge attached to the trailing edges of a vane while elastic ends are secured by slitted keepers on the backs of said wing panels thus forming a barrier as the trailing vertical edges of the wing panels meet above the quarter channel to prevent a flow of air between said vanes and slow the forward movement of a arrow, said wing panels of said decelerater device open rearwardly on arrow's departure from a bow as air is forced against said wing panels while elastic member stretches and wing panels flex at the vane-wing panel juncture and said wing panels gradually close as arrow's momentum begins to slow, resulting in a shortened flight for said arrow.

* * * * *